US009550302B2

(12) United States Patent
Spaulding

(10) Patent No.: US 9,550,302 B2
(45) Date of Patent: Jan. 24, 2017

(54) UTILITY KNIFE WITH BLADE WIPER

(71) Applicant: STANLEY BLACK & DECKER, INC., New Britain, CT (US)

(72) Inventor: James Spaulding, Bristol, CT (US)

(73) Assignee: STANLEY BLACK & DECKER, INC., New Britain, CT (US)

( * ) Notice: Subject to any disclaimer, the term of this patent is extended or adjusted under 35 U.S.C. 154(b) by 166 days.

(21) Appl. No.: 13/724,034

(22) Filed: Dec. 21, 2012

(65) Prior Publication Data

US 2014/0173908 A1 Jun. 26, 2014

(51) Int. Cl.
*B26B 5/00* (2006.01)

(52) U.S. Cl.
CPC ..... *B26B 5/001* (2013.01); *B26B 5/003* (2013.01)

(58) Field of Classification Search
CPC ..... B26B 5/00; B26B 5/001–5/008; A61B 2017/32113; A61B 17/3213
USPC ..... 30/2, 162–163, 329–339; D8/99
See application file for complete search history.

(56) References Cited

U.S. PATENT DOCUMENTS 1,843,970 A 2/1932 Bodkin
1,890,506 A 12/1932 Frank et al.
2,140,209 A 12/1938 Rietveld
3,577,637 A 5/1971 Braginetz
3,593,417 A 7/1971 West et al.
3,708,881 A * 1/1973 Bennett ..... B26B 5/001 30/320
4,091,537 A * 5/1978 Stevenson, Jr. ..... B26B 29/02 30/151
4,361,926 A * 12/1982 Brush ..... A61B 18/1402 15/236.09
4,517,741 A 5/1985 Castelluzzo
4,586,256 A * 5/1986 Weimann ..... B26B 5/001 30/162
4,663,845 A 5/1987 Weimann
4,862,590 A 9/1989 Winyard et al.
4,920,646 A * 5/1990 Grant ..... F16B 21/186 30/162
4,930,218 A 6/1990 Jacoff
4,949,458 A * 8/1990 Davis et al. ..... 30/162
5,086,562 A 2/1992 Jacoff
5,101,564 A 4/1992 Melter
(Continued)

FOREIGN PATENT DOCUMENTS

DE 197 17 830 A1 10/1998
FR 2 585 979 A1 2/1987

*Primary Examiner* — Stephen Choi
*Assistant Examiner* — Evan MacFarlane
(74) *Attorney, Agent, or Firm* — Pillsbury Winthrop Shaw Pittman LLP

(57) ABSTRACT

A utility knife includes a handle, a blade holder assembly, a pair of resilient blade wiper members, and a spreader. The blade holder assembly is constructed and arranged to hold a blade at a position of use wherein the blade projects through an opening at a front end of the handle. The pair of resilient blade wiper members are biased towards one another and constructed and arranged to remove debris from side surfaces of the blade, which debris would otherwise be brought into an interior space of the handle when the blade is retracted into the front end of the handle through the opening. The spreader is constructed and arranged to spread the resilient blade wiper members apart to facilitate removal of the blade from the handle when the blade is in a blade change position.

28 Claims, 6 Drawing Sheets

(56) References Cited

U.S. PATENT DOCUMENTS

| | | | | |
|---|---|---|---|---|
| 5,144,749 | A | 9/1992 | Chen | |
| 5,299,355 | A | 4/1994 | Boda et al. | |
| 5,301,428 | A | 4/1994 | Wilcox | |
| 5,311,664 | A | 5/1994 | Abdul | |
| 5,519,908 | A | 5/1996 | Steinman et al. | |
| 5,581,890 | A | 12/1996 | Schmidt | |
| 5,797,188 | A | 8/1998 | Gilbert | |
| 5,878,501 | A * | 3/1999 | Owens et al. | 30/286 |
| 6,192,589 | B1 * | 2/2001 | Martone et al. | 30/125 |
| 6,308,418 | B1 | 10/2001 | Sweet | |
| 6,449,850 | B1 | 9/2002 | Gilbert | |
| 6,453,559 | B1 | 9/2002 | Marshall et al. | |
| 6,546,632 | B2 | 4/2003 | Gilbert | |
| 6,553,674 | B1 * | 4/2003 | Budrow | B26B 5/001 30/125 |
| 6,574,872 | B2 | 6/2003 | Roberts et al. | |
| 6,643,934 | B2 | 11/2003 | Pope | |
| 6,718,639 | B1 | 4/2004 | Kazanjian | |
| 6,971,178 | B2 | 12/2005 | Rowlay | |
| 7,296,354 | B2 | 11/2007 | Van Deursen et al. | |
| 7,356,928 | B2 | 4/2008 | Votolato | |
| 7,784,189 | B2 * | 8/2010 | Polei | 30/162 |
| 8,234,790 | B2 * | 8/2012 | Schmidt et al. | 30/151 |
| 8,549,755 | B2 * | 10/2013 | Ranieri et al. | 30/162 |
| 8,683,703 | B2 * | 4/2014 | Rowlay et al. | 30/162 |
| 8,732,956 | B2 * | 5/2014 | McGushion et al. | 30/151 |
| 2003/0131426 | A1 | 7/2003 | Schulling | |
| 2003/0154605 | A1 * | 8/2003 | Chao | 30/162 |
| 2004/0231475 | A1 * | 11/2004 | Cornfield et al. | 83/13 |
| 2009/0235535 | A1 * | 9/2009 | Circosta | A47L 13/08 30/162 |
| 2010/0037465 | A1 * | 2/2010 | Price | B26B 5/001 30/152 |
| 2010/0037467 | A1 * | 2/2010 | Rowlay | B26B 5/001 30/162 |
| 2010/0037468 | A1 * | 2/2010 | Rowlay | B26B 5/002 30/162 |
| 2010/0223793 | A1 * | 9/2010 | Hansen et al. | 30/162 |
| 2011/0162212 | A1 * | 7/2011 | Ranieri et al. | 30/162 |
| 2012/0311869 | A1 * | 12/2012 | Ichiyanagi et al. | 30/151 |
| 2013/0104405 | A1 * | 5/2013 | Garavaglia et al. | 30/295 |
| 2013/0239415 | A1 * | 9/2013 | Wagner | 30/162 |
| 2014/0317936 | A1 * | 10/2014 | Wu | 30/162 |

* cited by examiner

UTILITY KNIFE WITH BLADE WIPER

BACKGROUND

The present application relates generally to cutting devices, and, more particularly to utility knives. Cutting devices, such as utility knives, have been developed for use in various applications, such as, for example, construction, packaging and shipping, carpet installation, as well as other purposes. Utility knives generally include a disposable blade that is movable between deployed and storage positions.

SUMMARY

One aspect of the application relates to a utility knife that includes a handle, a blade holder assembly, a pair of resilient blade wiper members and a spreader. The handle has an interior space and has an opening at a front end. The blade holder assembly is constructed and arranged to hold a blade at a position of use wherein the blade projects through the opening at the front end of the handle and to retract the blade so that the blade is contained entirely within the interior space of the handle. The pair of resilient blade wiper members is disposed on opposite sides of the handle and the pair of resilient blade wiper members is biased towards one another. The pair of resilient blade wiper members is constructed and arranged to remove debris from side surfaces of the blade, which debris would otherwise be brought into the interior space of the handle when the blade is retracted into the front end of the handle through the opening. The spreader is constructed and arranged to spread the resilient blade wiper members apart to facilitate removal of the blade from the handle when the blade is in a blade change position.

These and other aspects of the present application, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the application. However, each of the drawings herein can be considered to be drawn to scale, as examples of embodiments, it being understood that other scales and proportions are also contemplated and covered by this application. As used in the specification and in the claims, the singular form of "a", "an", and "the" include plural referents unless the context clearly dictates otherwise.

DETAILED DESCRIPTION

Figure 1A:
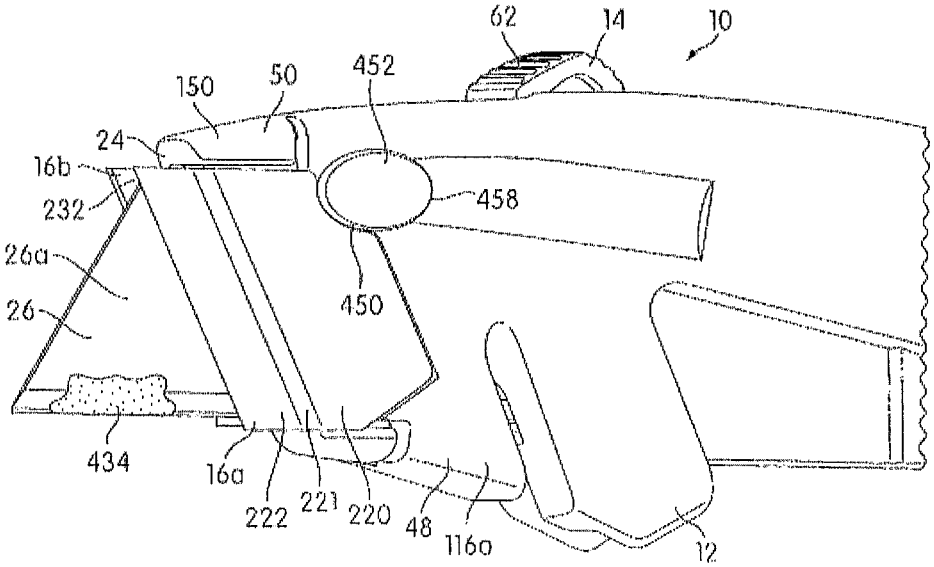
FIGS. 1A and 1B are partial left side perspective views of a utility knife with a blade at a position of use and with the blade being retracted into the handle, respectively, in accordance with an embodiment of the present application.

FIGS. 1-4 and 7 show a utility knife 10 in accordance with an embodiment of the present application. The utility knife 10 includes a handle 12, a blade holder assembly 14 (as shown in FIGS. 4-7), a pair of resilient blade wiper members 16*a* and 16*b* and a spreader 18.

The handle 12 has an interior space 20 and has an opening 22 at a front end 24. The blade holder assembly 14 is constructed and arranged to hold a blade 26 at a position of use wherein the blade projects through the opening 22 at the front end 24 of the handle 12 and to retract the blade so that the blade 26 is contained entirely within the interior space 20 of the handle 12.

The pair of resilient blade wiper members 16*a* and 16*b* is connected to opposite sides 116*a* and 116*b* of the handle 12 and the pair of resilient blade wiper members 16*a* and 16*b* is biased towards one another. The pair of resilient blade wiper members 16*a* and 16*b* is constructed and arranged to remove debris from side surfaces 26*a* and 26*b* of the blade 26, which debris would otherwise be brought into the interior space 20 of the handle 20 when the blade 26 is retracted into the front end 24 of the handle 12 through the opening 22.

Figure 7:
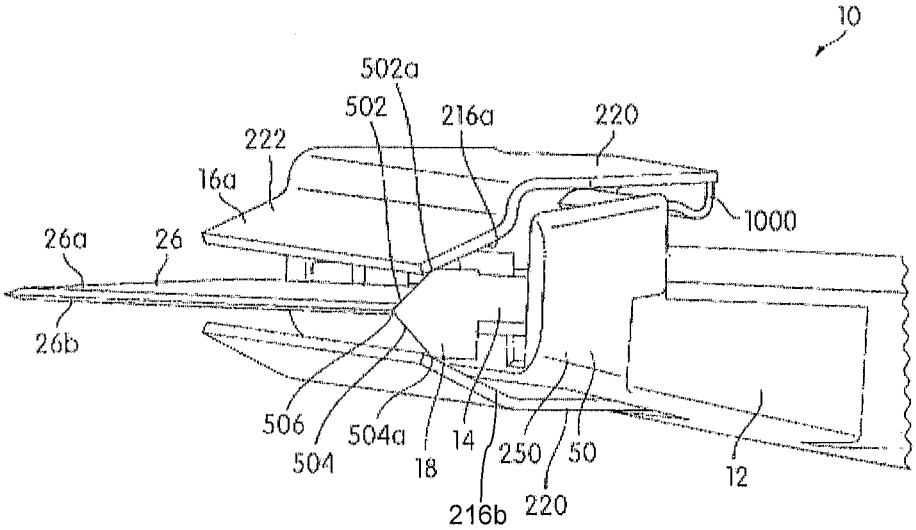
FIG. 7 is a bottom plan view of utility knife with the blade at a blade change position, wherein one handle portion of the utility knife handle is not shown for purposes of clarity, in accordance with an embodiment of the present application.

The spreader 18 is constructed and arranged to spread the resilient blade wiper members 16*a* and 16*b* apart to facilitate removal of the blade 26 from the handle 12 when the blade 26 is in a blade change position (as shown in FIG. 7).

The handle 12 is made of an appropriate material (such as aluminum or zinc) or other material of suitable strength. In one embodiment, the handle 12 is made of molded plastic material. The handle 12 includes two mating handle portions 48, 50. The first handle portion 48 and the second handle portion 50 are secured together to form the handle 12 by any securing method.

In one embodiment, the exterior surface of the handle 12 is suitably contoured to assist the user in holding onto the handle 12 and to facilitate employment of the blade 26 to perform various cutting tasks. Specifically, referring to FIG. 4, in one embodiment, the top portion of the handle 12 is contoured or arranged, for example, slightly convexly, to more comfortably accommodate the palm of the user's hand.

In one embodiment, one or more gripping members are mountable on the handle 12 in a position to engage the palm of a gripping hand of the user to provide the palm with a comfortable gripping surface. In one embodiment, the gripping members are made of a suitable molded plastic material. In another embodiment, the gripping members are made of a suitable molded plastic material and are coated with a layer of an elastomeric material, such as rubber.

In one embodiment, the handle 12 may optionally be provided with a pair of attachment apertures to facilitate attachment of the utility knife 10 to a tool belt or to provide a way to hang the utility knife 10 for storage when not in use.

In one embodiment, a spare blade carrier that is configured to carry a plurality of spare blades may be disposed within the handle 12 (e.g., in the interior space 20 of the handle 12). In various embodiments, the structure of an exemplary spare blade carrier can be of the type described in commonly assigned U.S. Pat. No. 5,797,188; and U.S. Pat. No. 6,192,589; and U.S. Patent Application Publication No. 2010/0037467, which are each hereby incorporated by reference in their entirety.

Figure 3:
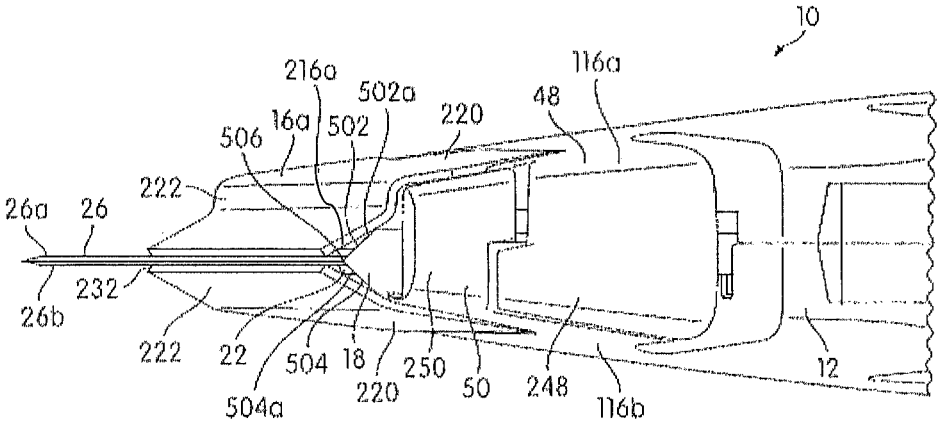
FIG. 3 is a partial bottom plan view of utility knife with the blade at the position of use in accordance with an embodiment of the present application.

In one embodiment, the first handle portion 48 and the second handle portion 50 provide a first cooperating interlocking structure 148 and a second cooperating interlocking structure 150, respectively. The first and second cooperating interlocking structures 148 and 150 are configured to interlock with one another to prevent relative pivotal movement (or other movement) of the first and second handle portions 48, 50 of the handle 12 away from one another (prevents separation). In one embodiment, the first and second cooperating interlocking structures are located near top surface portions of the first and second handle portions 48, 50 of the handle 12, respectively. In one embodiment, the first handle portion 48 and the second handle portion 50 may provide an additional arrangement of this same first and second cooperating interlocking structures, for example, 248 and 250 (as shown in FIG. 3) being disposed near bottom surface portions of the first and second handle portions 48, 50 of the handle 12, respectively so that both top and bottom surface portions of the first and second handle portions 48, 50 of the handle 12 have such first and second cooperating interlocking structures.

Figure 2:
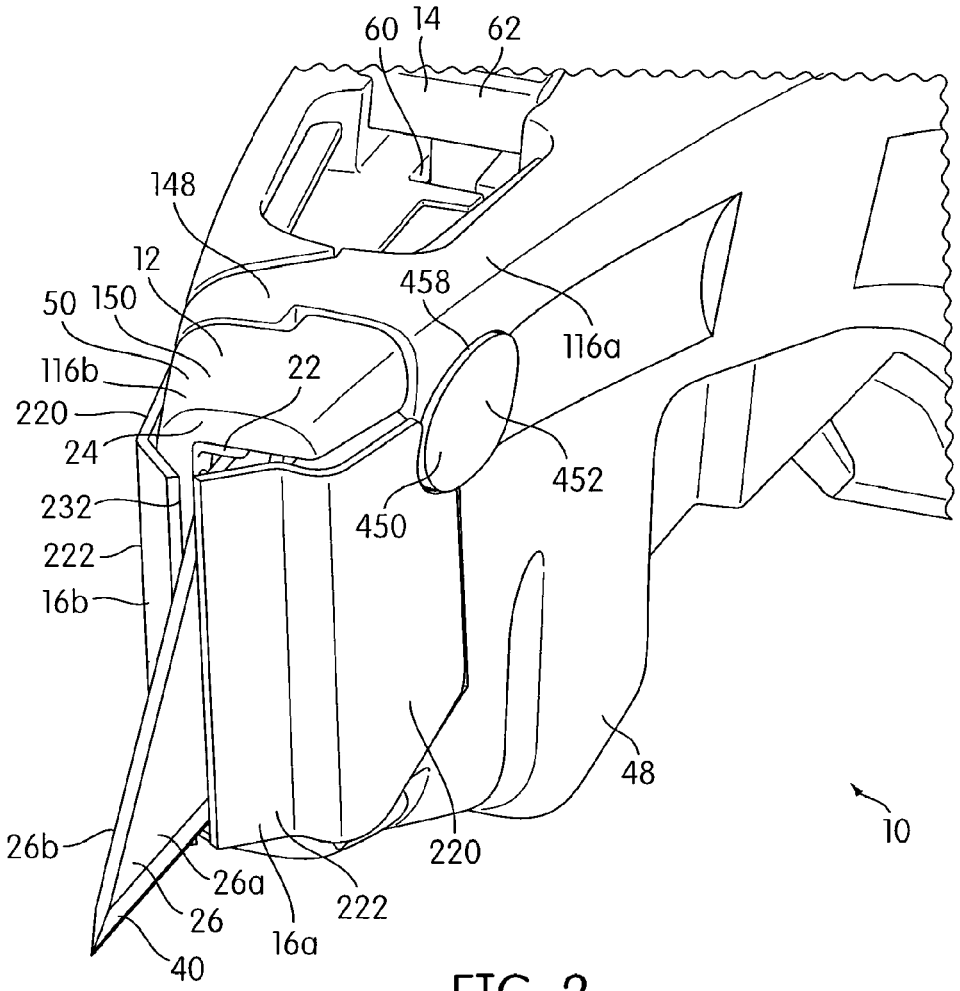
FIG. 2 is a partial upper left side perspective view of the utility knife with the blade at the position of use in accordance with an embodiment of the present application.

In one embodiment, as shown in FIG. 2, the first and the second handle portions 48 and 50 cooperate to form an upper slot 60 for a manually engageable member 62 of the blade holder assembly 14, and to form the opening 22 at the front end 24 sized to allow the blade 26 mounted in the blade holder assembly 14 to move in and out of the handle 12.

Figure 4:
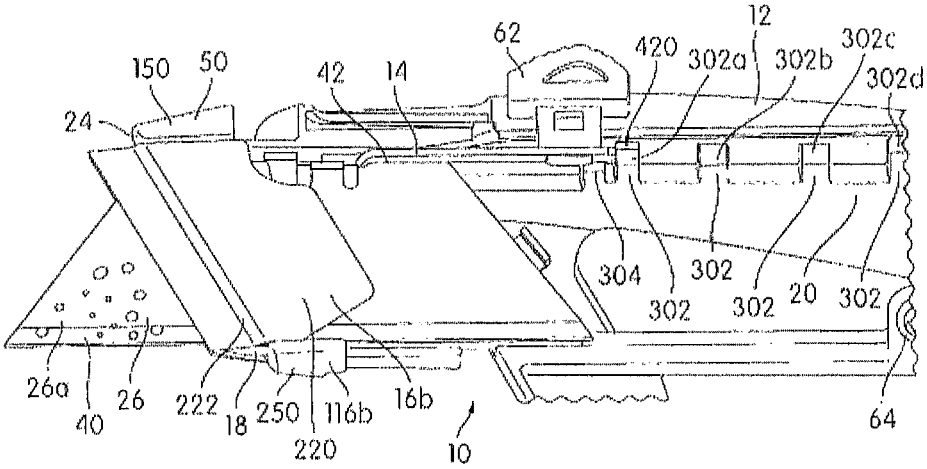
FIG. 4 is another left side perspective view of the utility knife with the blade at the position of use, wherein one handle portion of the utility knife handle is not shown for purposes of clarity, in accordance with an embodiment of the present application.

In one embodiment, as shown in FIG. 4, the second handle portion 50 includes opening 64 that is constructed and arranged to receive the fastener, when the first handle portion 48 is connected to the second handle portion 50. In one embodiment, the first handle portion 48 also includes such an opening (not shown) that is constructed and arranged to receive the fastener, when the first handle portion 48 is connected to the second handle portion 50. In one embodiment, the fastener is constructed and arranged to pass through the openings of the second handle portion 50 and the first handle portion 48 to fasten or connect the first handle portion 48 and the second handle portion 50 together.

Figure 5:
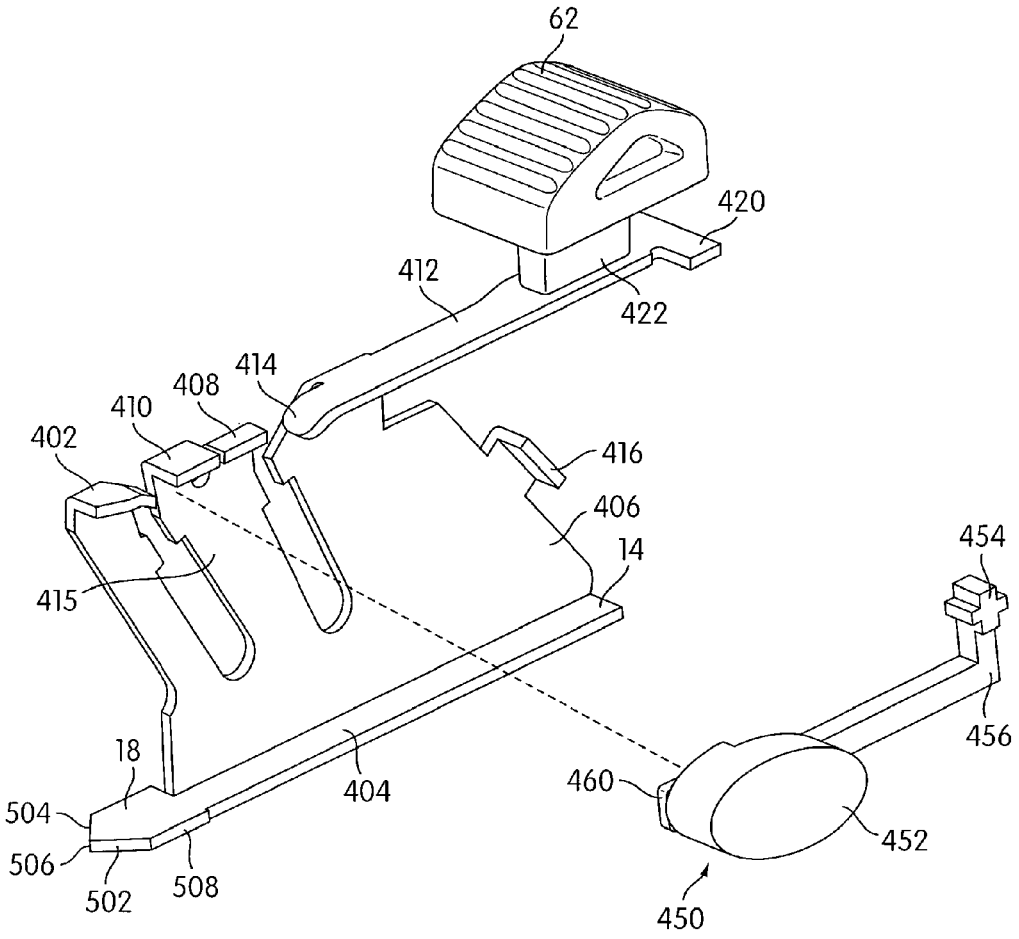
FIG. 5 is a left side perspective view of a blade holder assembly of the utility knife in accordance with an embodiment of the present application.
Figure 6:
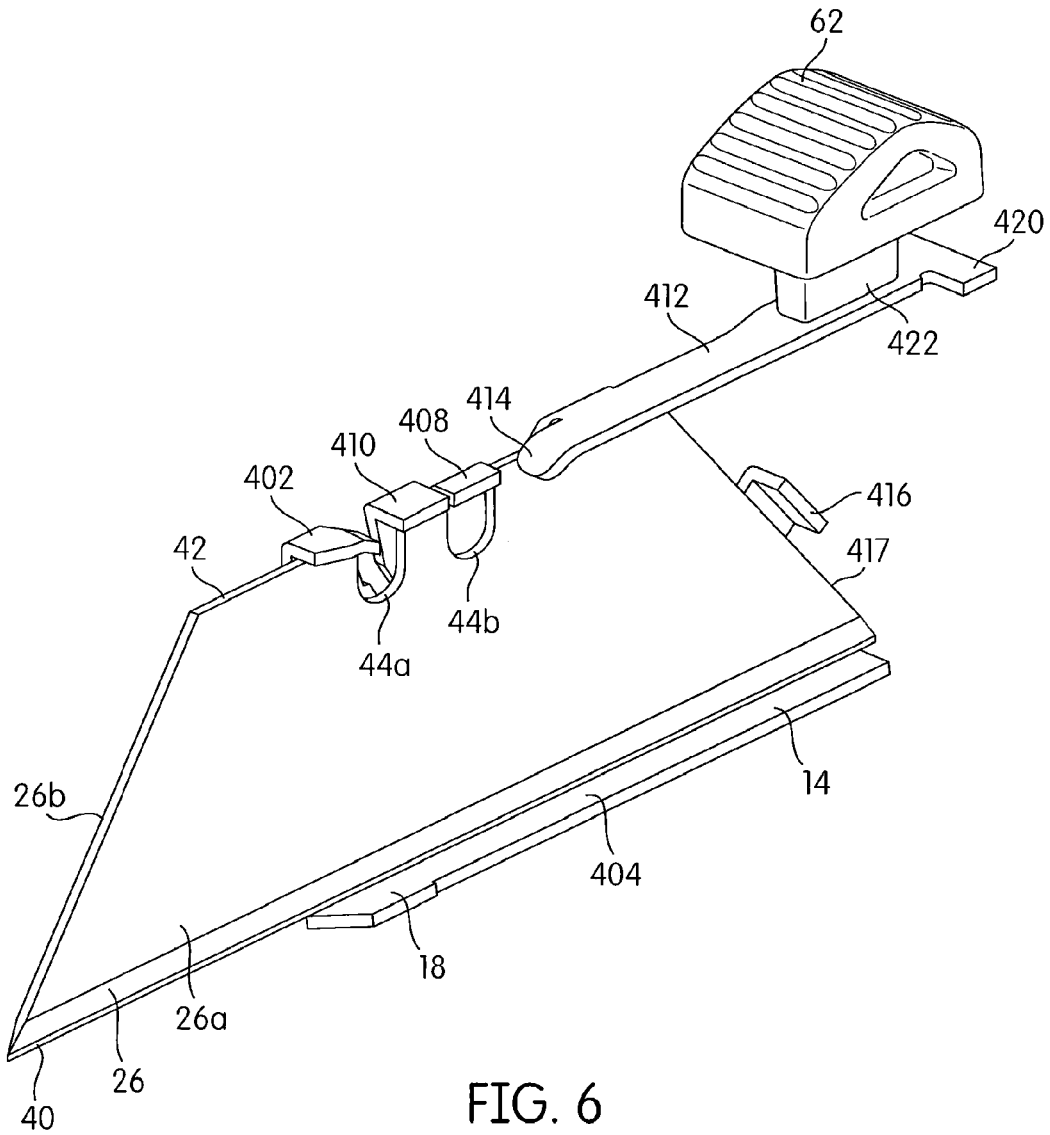
FIG. 6 is a left side perspective view of the blade holder assembly of the utility knife and a blade releasing structure with the blade mounted on the blade holder assembly and with the blade being at the position of use in accordance with an embodiment of the present application.

In one embodiment, notches 302*a*-302*d* and 304 are formed in the top interior of each of the first and the second handle portions 48 and 50. As will be clear from the discussion below, the engagement of a portion 420 (as shown in FIGS. 4-6) of the blade holder assembly 14 with notches 302*a*-302*d* defines four cutting positions of blade 26 and the engagement of the portion 420 of the blade holder assembly 14 with notch 304 defines the blade change position (blade replacement position) of blade 26. In the illustrated embodiment, the notch 304 is positioned forwardly of the notches 302*a*-302*d* so that the engagement of the portion 420 of the blade holder assembly 14 with notch 304 defines a forward most position of the blade 26.

In one embodiment, the blade 26 has a trapezoidal shape, a longest side of which includes the linear cutting edge 40. Other cutting edges and blade shapes can also be used (e.g., a hook type blade). A shorter side 42 (as shown in FIG. 6) of the blade 26 includes at least one locating notch 44*a*, 44*b* configured to mate with the complementary blade engaging member 408 provided on the blade holder assembly 14 to prevent the blade 26 from moving longitudinally forwardly or rearwardly out of engagement with the blade holder assembly 14, as known in the art.

The interior space 20 of the handle 12 is configured to receive the blade holder assembly 14 that may be of conventional construction and that is constructed and arranged to hold the conventional utility knife blade 26 at a position of use.

In the illustrated embodiment, the blade holder assembly 14 is movable between a retracted position wherein the blade 26 is disposed within the handle 12 and an extended position (shown, for example, in FIGS. 1-4) wherein the blade 26 protrudes outwardly (e.g., from the opening 22 at the front end 24) from the handle 12 to enable a cutting operation. The extended position may include not only a fully extended position, but may also include at least one intermediate position wherein the blade can be releasably locked at a position in which only a part of the possible extent of the blade extends from the handle. The manually engageable member 62 is slidably disposed on the handle 12 and is operatively connected with the blade holder assembly 14 such that movement of the manually engageable member 62 moves the blade holder assembly 14 between the extended and retracted positions.

In addition to the retracted and extended positions described above, in one embodiment, the blade holder assembly 14 is also constructed and arranged to position the blade 26 at a blade change position (as shown in FIG. 7) wherein the blade 26 is prepared for removal from the handle 12. In one embodiment, the blade change position is a forwardmost position of the blade 26.

In one embodiment, the present application contemplates that the blade 26 can be mounted or released/replaced with respect to the blade holder assembly 14 only when the blade holder assembly 14 is in the blade change position. While this position is slightly forwardly beyond the fully extended position for normal use in a cutting operation, it is alternately contemplated that the fully extended position for use may itself also institute the blade change position.

FIGS. 5 and 6 show views of an exemplary blade holder assembly 14 of the utility knife 10, without and with the blade 26 mounted in the blade holder assembly 14, respectively.

Referring to FIGS. 5 and 6, the blade holder assembly 14 includes a generally upright planar blade support portion 406. A flange portion 402 extends generally perpendicularly from the top of the blade support portion 406 toward the first handle portion 48. A second flange portion 404 parallel to the flange portion 402 extends generally perpendicularly from the bottom of the blade support portion 406 toward the first handle portion 48.

The blade 26 engages against the planar support portion 406 and is retained between the flange portions 402 and 404 of the blade holder assembly 14 for generally upright vertical retention.

The blade 26 is retained in a fixed longitudinal position to the blade holder assembly 14 by the blade engaging member 408. The blade engaging member 408 generally laterally projects from the blade holder assembly 14 at a position slightly below the flange portion 402. The blade engaging member 408 engages the notch 44*b* at the top of the blade 26. The blade 26 may also be retained in a fixed longitudinal position by a rearward retention tab member 416 which extends obliquely relative to the flange portions 402 and 404 for engaging a rear non-cutting edge 417 of the blade 26.

The blade holder assembly 14 may also include an integral lateral retention tab 414 extends from a resilient finger structure 412 to help secure the blade 26 within the blade holder assembly 14.

When the blade holder assembly 14 is moved to a blade change position (i.e., a forwardmost position of the blade 26), a lateral movement of the tab member 410 forces the blade engaging member 408 to disengage from the notch 44*b* of the blade 26 to allow for replacement of the blade 26 through the front opening 22 of the knife handle 12.

In one embodiment, the lateral movement of the tab member 410 may be achieved using a blade releasing structure 450 that is associated with the blade holder assembly 14. The blade releasing structure 450 may include a manually engageable portion 452 that is movable to disengage the blade 26 from the blade holder assembly 14 to enable the blade 26 to be removed from the blade holder assembly 14. In one embodiment, the blade releasing structure 450 is an integral, resilient structure made of a suitable molded plastic material.

The blade releasing structure 450 includes an attachment portion 454 connected with one of the handle portions 48, 50. The blade releasing structure 450 includes a resilient arm member 456 that extends integrally outwardly from the manually engageable portion 452 to the attachment portion 454 at the opposite end thereof.

The handle portion 48 is provided with a lateral aperture 458. The blade releasing structure 450 is mounted to the handle portion 48 by press fitting the attachment portion 454 into an opening in the top interior of the handle portion 48 and allowing the manually engageable portion 452 to be slidably received within the lateral aperture 458 to permit lateral movement of the manually engageable portion 452 with respect to the handle portion 48 of the handle 12 between a neutral or blade retaining position and a releasing position. In one embodiment, the resilient arm member 456 is constructed and arranged to bias the manually engageable portion 452 outwardly toward its neutral position. In one embodiment, the attachment portion 454 retains the blade releasing structure 450 with the handle portion 48 when the handle portions 48, 50 are disconnected from one another.

The structure of the blade releasing structure can be of the type described in more detail in U.S. Pat. No. 3,577,637, and commonly assigned U.S. Pat. No. 6,192,589, which are each hereby incorporated by reference in their entirety.

A pair of oppositely projecting latching tab members 420 at the rear end of the resilient finger structure 412 are biased by the resilience of the finger 412 to be received in any one of notches 302*a*-302*d* to latch the blade holder assembly 14 and hence to securely position a mounted blade 26 in a selected longitudinal position. In one embodiment, reception of tab members 420 in the notches 302*a*-302*d* defines four cutting positions of blade 26. In one embodiment, reception of tab members 420 in the notch 304 defines the blade change position (blade replacement position) of blade 26.

The thumb button 62 is connected to the resilient finger 412 by a neck 422 which extends upwardly through a longitudinal slot 60 formed in the top of the utility knife handle 12. The blade holder assembly 14 may be manually longitudinally shifted by pressing the thumb button 62 to unlatch the latching tab 420 and moving the blade holder assembly 14 longitudinally with respect to the first and second handle portions 48 and 50.

It should be appreciated that the blade holder assembly 14 is an integral member which may be formed from a sheet of metal such as steel by a process wherein the steel sheet is cut and then bent to form the foregoing described flanges, lugs, fingers, and lateral retention tabs. In another embodiment, the blade holder assembly 14 may also be die cast or formed from reinforced plastic. In various embodiments, the structure of the illustrated blade holder assembly 14 can be of the type described in commonly assigned U.S. Pat. Nos. 4,586,256; 6,192,589; 6,971,178; and 7,296,354, which are each hereby incorporated by reference in their entirety.

Each resilient blade wiper member 16*a* or 16*b* comprises a first portion 220 disposed substantially side-by-side relationship with their respective handle portions 48, 50, and a second portion 222 protruding inwardly towards the opening 22 located at the front end 24.

The first portions 220 of the resilient blade wiper members 16*a* and 16*b* are constructed and arranged to connect the resilient blade wiper member 16*a* and 16*b* to the opposite sides 116*a* and 116*b* of the handle 12.

In one embodiment, each first portion 220 may comprise a pair of engaging/protruding members that are constructed and arranged to engage with a pair of recesses on an outer surface of the handle 12 to secure each resilient member 16*a* or 16*b* to the handle 12. It is contemplated that, in another embodiment, each first portion 220 comprises a pair of recesses that are constructed and arranged to engage with a pair of engaging/protruding members on an outer surface of the handle 12 to secure each resilient member 16*a* or 16*b* to the handle 12. In one embodiment, as shown in FIG. 7, a portion 1000 helps secure the resilient member 16*a* to the handle portion 48 of the handle 12. Though not shown in the figures, an opposing portion (similar to portion 1000) helps secure the resilient member 16*b* to the handle portion 50 of the handle 12. In one embodiment, the pair of recesses or projections is positioned in a notch or groove located on the outer surface of the handle 12.

In one embodiment, the first portions 220 of the resilient blade wiper members 16*a* and 16*b* are connected to their respective sides 116*a* and 116*b* of the handle 12 by any attachment mechanism as would be appreciated by one skilled in the art. In one embodiment, the attachment mechanism includes, but not limited to, welding, fastening, friction fitting, snap fitting, or adhesive bonding.

The second portions 222 of the resilient blade wiper members 16*a* and 16*b* are constructed and arranged to rest on the side surfaces 26*a* and 26*b* of the blade 26, when the blade 26 is in the position of use. In one embodiment, the second portions 222 of the resilient blade wiper members 16*a* and 16*b* form an opening 232 (as shown in FIGS. 1-3) therebetween to allow the blade 26 to move to the position of use. The opening 232 formed between the resilient blade wiper members 16*a* and 16*b* form a width smaller than a width of the blade 26, when the blade 26 is stored in the handle 12. In one embodiment, the height of the resilient members 16*a* and 16*b* is at least equal to a height of the blade 26. In one embodiment, the resilient blade wiper members 16*a* and 16*b* engage with the blade 26 along an entire height of the blade 26 (from top edge to cutting edge of the blade 26) to remove debris from entire height of the blade. In one embodiment, the resilient blade wiper members 16*a* and 16*b* are configured to wipe the entire extent of the blade edge that projected through the opening 22 at the front end 24 of the handle 12 as the blade 26 is retracted into the handle 12. In another embodiment, only a portion of the blade is engaged with the wipers.

In the illustrated embodiment, the resilient blade wiper members 16*a* and 16*b* are two separate members that are individually connected to the handle 12, however, it is contemplated that in another embodiment the resilient blade wiper members 16*a* and 16*b* may be formed as a unitary structure that is connected to the handle 12, wherein the unitary structure may include two resilient blade wiper members that are connected to each other.

In one embodiment, the resilient blade wiper members 16*a* and 16*b* may be made from any suitable resilient material. The resilient blade wiper members 16*a* and 16*b* may be made from a plastic and/or an elastomeric material in another embodiment.

The resilient blade wiper member 16*a* and 16*b* are disposed to rest on the side surfaces 26*a* and 26*b* of the blade 26 when the blade 26 projects through the opening 22 at the front end 24 of the handle 12 so as to remove debris from the side surfaces 26*a* and 26*b* of the blade 26 when the blade 26 is retracted into the handle 12.

In one embodiment, the first and second portions of each resilient blade wiper member are connected to each other using a connector member 221. In one embodiment, the connector member 221 lies on a plane that is generally perpendicular to the first portion 220 of the resilient blade wiper member.

The spreader 18 is constructed and arranged to provide a clearance for the blade change operation. In one embodiment, the spreader 18 is constructed and arranged to spread the resilient blade wiper members 16*a* and 16*b* apart to facilitate removal of the blade 26 from the handle 12 when the blade 26 is in a blade change position (as shown in FIG. 7).

Referring to FIGS. 3, 5 and 7, the spreader 18 includes surfaces 502, 504. The surfaces 502, 504 are directed inwardly towards the clearance or opening 232 formed between the resilient blade wiper member 16*a* and 16*b*. The surfaces 502, 504 join each other to form a tip portion 506. The surfaces 502, 504 also include ramp surfaces 502*a*, 504*a* that are constructed and arranged to contact and bear against inner surfaces 216*a*, 216*b* of the blade wiper members 16*a* and 16*b*, respectively.

In one embodiment, the spreader 18 is integrally formed with the blade holder assembly 14 and is disposed at a front end 508 thereof. For example, the spreader is integrally formed with the blade holder assembly using a stamping operation, an extrusion operation, a forging operation, or any other mechanism as will appreciated by one skilled in the art.

In another embodiment, the spreader 18 is separately formed from the blade holder assembly 14 and later connected to the blade holder assembly 14 by any attachment mechanism as will appreciated by one skilled in the art. For example, the separately formed spreader is attached/connected to the blade holder assembly using a welding operation, an adhesive, or any other attachment mechanism as will appreciated by one skilled in the art.

The operation of the resilient blade wiper members 16*a*, 16*b* is now described. The resilient blade wiper members 16*a* and 16*b* are constructed and arranged to remove debris from the side surfaces 26*a* and 26*b* of the blade 26, before the blade 26 is retracted into the handle 12, to prevent debris from entering into the handle 12 and thus to minimize and to avoid jamming of the blade 26 in the handle 12.

In one embodiment, the resilient blade wiper members 16*a*, 16*b* are constructed and arranged to be spring loaded so as to contact the sides 26*a*, 26*b* of the blade 26 to wipe off any materials that may adhere to the blade 26 when the blade 26 is retracted into the interior space 20. In one embodiment, the resilient blade wiper members 16a and 16*b* may be attached to the handle portions 48, 50 so that the resilient blade wiper members 16*a* and 16*b* apply pressure to the sides 26*a*, 26*b* of the blade 26 and clean the blade 26 during retraction, and spring open to allow clearance for the blade change operation.

Figure 1B:
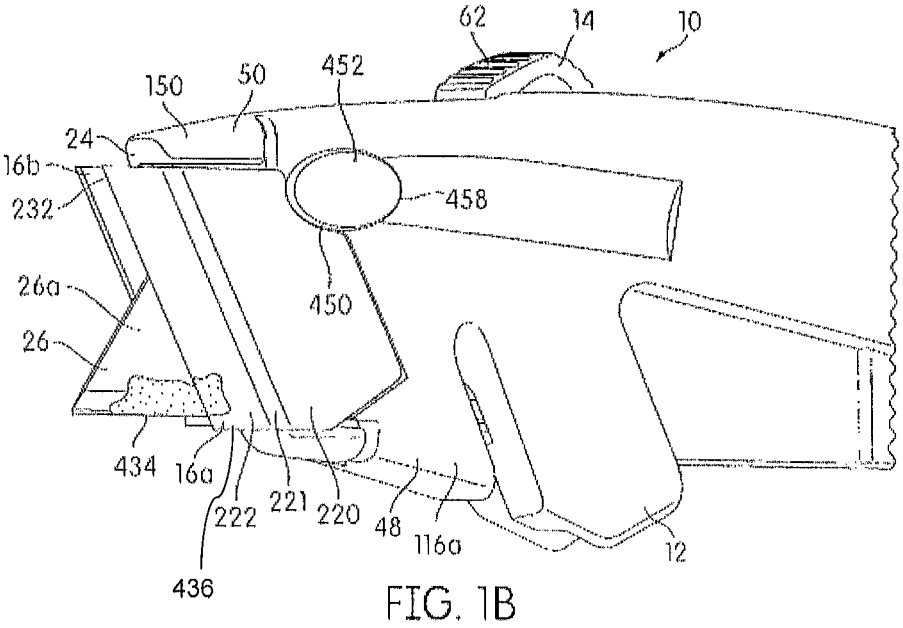

As shown in FIG. 1A, the blade 26 of the utility knife 10 is at a position of use, wherein debris 434 is located on the side surfaces 26*a*, 26*b* on the blade 26. As shown in FIG. 1B, as the blade 26 is retracted into the handle 12, the blade wiper members 16*a*, 16*b* resting on the side surfaces 26*a*, 26*b* of the blade 26 are constructed and arranged to allow the blade 26 to be retracted into the handle 12 and to simultaneously remove the debris 434 from the side surfaces 26*a*, 26*b* of the blade 26. The debris 434, thus, removed is collected on surface portions 436 of the second portions 222 of the resilient members 16*a*, 16*b* and may be cleaned or wiped off easily.

By removing the debris 434 from the side surfaces 26*a*, 26*b* of the blade 26 before the blade 26 is retracted into the handle 12, the debris 434 does not enter the handle 12, and consequently does not get trapped in the handle 12 to jam the blade 26. The blade wiper member 16*a*, 16*b* contacts the side surfaces 26*a*, 26*b* of the blade 26 thereby removing debris 434 from the blade 26 and storing the clean blade 26 in the handle 12.

The operation of the blade holder assembly 14 is described below. The latch tab members 420 and the locking notches 302*a-d* and 304 cooperate to releasably lock the blade holder assembly 14 in a selected one of a plurality of positions including a fully retracted position, a fully extended position, at least one intermediate extended position, and/or a blade change position. When the user depresses the manually engageable member 62 with the thumb, the finger structure 412 resiliently moves downwardly, thereby moving the latch tab members 420 out of locking engagement with a notches 302*a-d* or 304 in which it was disposed. While holding the manually engageable member 62 in the downward, unlocked position, the user can then exert a pushing or pulling force in the longitudinal direction to slide the blade holder assembly 14 in the generally longitudinal direction between retracted position, fully extended position, intermediate positions, and/or blade change position.

The operation of the spreader 18 is described below. Referring to FIGS. 3, 4 and 7, while holding the manually engageable member 62 in the downward, unlocked position, the user can then exert a pushing or pulling force in the longitudinal direction to slide the blade holder assembly 14 in the generally longitudinal direction from the fully extended position (FIGS. 3 and 4) to the blade change position (as shown in FIG. 7).

As the blade holder assembly 14 is being moved from the fully extended position (FIGS. 3 and 4) to the blade change position (as shown in FIG. 7), the ramp surfaces 502*a*, 504*a* contact and bear against inner surfaces 216*a*, 216*b* of the blade wiper members 16*a*, 16*b*, respectively. This action pushes the inner surfaces 216*a*, 216*b* of the blade wiper members 16*a*, 16*b* and, thus, the blade wiper members 16*a*, 16*b* outwardly away from each other. Continued longitudinal movement of the blade holder assembly 14 (from the fully extended position (FIGS. 3 and 4) to the blade change position (as shown in FIG. 7)) causes the blade wiper members 16*a*, 16*b* to further spread apart so as to provide sufficient clearance for the blade removal/insertion.

While holding the manually engageable member 62 in this blade change position, the user can then depress manually engageable portion 452 of the blade releasing structure 450, thereby causing a longitudinally extending arm structure 460 integrally formed on the blade releasing structure 450 to move into abutting engagement with the intermediate flange 410 on the blade holder assembly 14. Continued transverse inward movement of the manually engageable portion 452 thereafter causes the central portion 415 of the blade support 406 to resiliently move out of its equilibrium position, thereby moving the blade engaging member 408 from a blade locking position to a blade releasing position. The user can then mount or release/replace the blade 26 with respect to the blade holder assembly 14.

Although the application has been described in detail for the purpose of illustration based on what is currently considered to be the most practical and preferred embodiments, it is to be understood that such detail is solely for that purpose and that the application is not limited to the disclosed embodiments, but, on the contrary, is intended to cover modifications and equivalent arrangements that are within the spirit and scope of the appended claims. For example, it is to be understood that the present application contemplates that, to the extent possible, one or more features of any embodiment can be combined with one or more features of any other embodiment.

What is claimed is:

1. A utility knife, comprising:

a handle having an interior space and an opening at a front end;

a blade holder assembly constructed and arranged to hold a blade at a position of use wherein the blade projects through the opening at the front end of the handle and to retract the blade so that the blade is contained entirely within the interior space of the handle;

a pair of resilient blade wiper members disposed on opposite side surfaces of the handle, wherein the pair of resilient blade wiper members is biased towards one another and constructed and arranged to contact side surfaces of the blade to remove debris from the side surfaces of the blade, which debris would otherwise be brought into the interior space of the handle when the blade is retracted into the front end of the handle through the opening, the front ends of the resilient blade wiper members defining an opening therebetween disposed forwardly of the handle opening at the front end; and a spreader forming part of the blade holder and constructed and arranged to spread the resilient blade wiper members apart so as to be spaced from and no longer contact the side surfaces of the blade along an entire length of the resilient blade wiper members to facilitate removal of the blade from the handle when the blade is in a blade change position, wherein, in the blade change position, the side surfaces of the blade are spaced from and exposed to inner surfaces of the resilient blade wiper members, and wherein, in the blade change position, the spreader is positioned sufficiently forward of the handle opening to forcibly engage the resilient blade wiper members at a position of engagement forwardly of the handle opening to spread the resilient blade wiper members apart.

2. The utility knife of claim 1, wherein the blade change position is a forward most position of the blade.

3. The utility knife of claim 1, wherein the spreader is integrally formed with the blade holder assembly and is disposed at a front end of the blade holder assembly.

4. The utility knife of claim 1, wherein the spreader is coupled to the blade holder assembly.

5. The utility knife of claim 1, wherein each resilient blade wiper member comprises a first portion disposed in a substantially side-by-side relationship with the handle and a second portion protruding inwardly towards the opening.

6. The utility knife of claim 5, wherein each first portion comprises a pair of first engaging members that is constructed and arranged to engage with a pair of second engaging members on the outer surface of the handle to secure each resilient blade wiper member to the handle.

7. The utility knife of claim 5, wherein the second portions of the resilient blade wiper members form the opening therebetween to allow the blade to move to the position of use.

8. The utility knife of claim 5, wherein the second portions of the resilient blade wiper members are constructed and arranged to rest on the side surfaces of the blade, when the blade is in the position of use.

9. The utility knife of claim 7, wherein the opening in the resilient blade wiper members has a width smaller than a width of the blade, when the blade is stored in the handle.

10. The utility knife of claim 5, wherein a height of the resilient blade wiper members is at least equal to a height of the blade.

11. The utility knife of claim 5, wherein the resilient blade wiper members engage with substantially all of the side surfaces of the blade or engage with a portion of the side surfaces of the blade.

12. The utility knife of claim 5, wherein the resilient blade wiper member are disposed to rest on the side surfaces of the blade when the blade projects through the opening at the front end of the handle so as to remove debris from the side surfaces of the blade when the blade is retracted into the front end of the handle through the opening.

13. The utility knife of claim 1, wherein the handle comprises first and second handle portions, and wherein the first and second handle portions include cooperating interlocking structures configured to interlock with one another to prevent relative movement of the first and second handle portions.

14. The utility knife of claim 13, further comprising one or more position of use notches formed on a top interior of the first and second handle portions, and wherein the one or more position of use notches are configured to engage with a portion of the blade holder assembly to define one or more positions of use of the blade, and wherein the one or more positions of use of the blade includes the position of use.

15. The utility knife of claim 14, further comprising a blade change position notch formed on the top interior of the first and second handle portions, and wherein the blade change position notch is configured to engage with the portion of the blade holder assembly to define blade change position of the blade.

16. The utility knife of claim 15, wherein the blade change position notch is positioned forwardly of the position of use notches so that the engagement of the portion of the blade holder assembly with the blade change position notch defines a forward most position of the blade.

17. The utility knife of claim 1, wherein the spreader includes ramp surfaces that are configured to contact inner surfaces of the blade wiper members so as to spread the blade wiper members apart to facilitate removal of the blade.

18. The utility knife of claim 17, wherein, as the blade holder assembly is being moved from the position of use to the blade change position, the ramp surfaces of the spreader contact and bear against the inner surfaces of the blade wiper members so as to push the inner surfaces, and, thus, the blade wiper members outwardly from each other.

19. The utility knife of claim 18, wherein further continued longitudinal movement of the blade holder assembly causes the blade wiper members to further spread apart so as to provide clearance for the blade removal.

20. The utility knife of claim 1, wherein the spreader is configured to be operatively associated with the blade holder assembly such that, as the blade holder assembly is being moved from the position of use to the blade change position, the spreader contacts and bears against inner surfaces of the resilient blade wiper members so as to push the inner surfaces, and, thus, the resilient blade wiper members outwardly from each other.

21. The utility knife of claim 1, further comprising a blade, the blade having a linear edge and a cutting edge opposite the linear edge, and wherein the spreader is configured such that the spreader does not engage with the entire length of the cutting edge of the blade when the blade is in the blade change position.

22. The utility knife of claim 1, wherein the blade holder assembly includes an upright planar blade support member, a top flange member that extends perpendicularly from the top of the blade support member, and a bottom flange member that extends perpendicularly from the bottom of the blade support member, and wherein, at the position of use, the blade engages against the blade support member and is held between the top and the bottom flange members.

23. The utility knife of claim 22, wherein the spreader lies in a plane that is perpendicular to a plane of the blade support member of the blade holder assembly.

24. The utility knife of claim 22, wherein the spreader lies in the same plane as the bottom flange member of the blade holder assembly.

25. The utility knife of claim 22, wherein the spreader includes inwardly inclined ramp surfaces that form a pointed portion, and wherein the inwardly inclined ramp surfaces and the pointed portion of the spreader lie in a plane that is perpendicular to a plane of the blade support member of the blade holder assembly.

26. The utility knife of claim 25, wherein the inwardly inclined ramp surfaces and the pointed portion of the spreader extend away from the blade support member of the blade holder assembly in the plane that is perpendicular to the plane of the blade support member of the blade holder assembly.

27. The utility knife of claim 25, wherein the inwardly inclined ramp surfaces and the pointed portion of the spreader lie in the same plane as the bottom flange member of the blade holder assembly.

28. The utility knife of claim 1, wherein the resilient blade wiper members are formed from a plastic material, an elastomeric material, or a combination of plastic and elastomeric material.

* * * * *